United States Patent [19]

Thomsen

[11] Patent Number: 4,972,761

[45] Date of Patent: Nov. 27, 1990

[54] HYDRAULIC SAFETY BRAKE VALVE ARRANGEMENT FOR LOAD LOWERING

[75] Inventor: Svend E. Thomsen, Nordborg, Denmark

[73] Assignee: Danfoss A/S, Nordborg, Denmark

[21] Appl. No.: 285,027

[22] Filed: Dec. 16, 1988

[30] Foreign Application Priority Data

Jan. 7, 1988 [DE] Fed. Rep. of Germany ..... 3800188

[51] Int. Cl.[5] ..... F15B 11/04

[52] U.S. Cl. ..... 91/420; 91/445; 91/447

[58] Field of Search ..... 91/420, 445, 447; 60/460

[56] References Cited

U.S. PATENT DOCUMENTS 4,244,275 1/1981 Smilges ..... 91/445 X
4,342,256 8/1982 Andersen et al. ..... 91/420
4,411,189 10/1983 Miller ..... 91/420
4,418,612 12/1983 Nanda ..... 91/445
4,569,272 2/1986 Taylor et al. ..... 91/420

*Primary Examiner*—Edward K. Look
*Assistant Examiner*—George Kapsalas
*Attorney, Agent, or Firm*—Wayne B. Easton; Clayton R. Johnson

[57] ABSTRACT

A hydraulic safety brake valve arrangement for a motor controlled by a directional control valve. The safety brake valve arrangement has a main valve closing the load lowering conduit in a rest position. Pump pressure opens the main valve to throttle exhausted fluid and at the same time throttle fluid through the supply conduit to the opposed motor chamber. A compensating valve is placed in series with the main valve throttle for the loaded side of the motor. Motor speed is thereby controlled independent of the external loading on the motor.

16 Claims, 4 Drawing Sheets

HYDRAULIC SAFETY BRAKE VALVE ARRANGEMENT FOR LOAD LOWERING

BACKGROUND OF THE INVENTION

The invention relates to a hydraulic safety brake valve arrangement for a motor which is actuatable by a control valve and which can be loaded in at least one operating direction by an external force, comprising a main valve which, in the rest position, closes at least that motor conduit which serves as an outlet conduit in this operating direction, opens under the influence of the presssure at the connection on the pump side and thereby forms a first throttling point in the supply motor conduit and a second throttling point in the delivery motor conduit, the openings of both throttling points changing in the same sense and depending on the flow through the first throttling point at least during braking operation.

In a known arrangement of this kind (DE-OS 32 25 132), the slide of the main valve comprises two control edges which, in conjunction with two annular grooves, form the first and second throttling points. The slide is loaded at one end by the pressure at the connection on the pump side and at the other end by a spring and by the pressure at the connection of the first throttling point on the motor side. The spring holds the pressure drop at the first throttling point constant. The slide position thereby depends on the quantity. Since the main valve closes both motor conduits in the rest position and can be directly connected to the motor housing, it is ensured that, if there is a fracture in the hydraulic conduits, the liquid volume in the motor is kept shut. Since the opening of the second throttling point depends on the amount of flow through the first throttling point, the quantity delivered by the motor is also limited. This results in a braking effect that reduces the influence of the external force. However, with a given opening of the second throttling point, the quantity delivered depends on the external force. This is often undesirable because, for safety reasons, a particular deceleration must not be exceeded. This applies, for example, to all hydraulically actuated consumers subjected to preloading, such as cranes, excavators, lifts or like equipment, irrespective of whether their motor is a rotating or a linear motor. It is also disadvantageous that the first and second throttles are operative not only during braking operation but also during normal operation and therefore give rise to additional throttling losses.

SUMMARY OF THE INVENTION

The invention is based on the problem of providing a hydraulic safety brake valve arrangement of the aforementioned kind in which the motor speed, especially the braking speed, is independent of the external force (preloading) with a supply quantity that is predetermined by the control valve.

According to the invention, this problem is solved in that the second throttling point is in series with a compensating valve which holds the pressure drop constant at the second throttling point.

Since the compensating valve holds the pressure drop at the second throttling point constant, an accurately defined delivery quantity is ensured for each size of opening of the second throttle. This is independent of the size of the external force on the motor. When the control valve has determined a particular supply quantity and thereby the size of the opening of the first throttle, the delivery quantity is also fixed. This results in a very stable operation. Predetermined decelerations are not exceeded. Nor do any marked oscillations arise in the system.

In the simplest case, the compensating valve can be loaded in the closing direction by the pressure at the connection of the second throttling point on the motor side and in the opening direction by a spring and by the pressure of the second throttling point at the container side.

It is a particular advantage to connect the connection of the second throttling point at the container side by way of a refill check valve to the connection of the first throttling point on the motor side. Whenever refilling becomes necessary as a result of the external force, this can be brought about in the simplest way by way of the refill check valve.

Since the refill check valve does not branch off from the container, but rather from a conduit section disposed between the control valve and the second throttling point, there is an increased pressure which is given by the throttling resistance of the conduit and facilitates refilling.

In this connection, it is advisable to provide a counter pressure valve in the motor conduit on the delivery side, which holds the pressure at the connection of the second throttling point on the container side substantially constant at a value above the container pressure Refilling is therefore at a stable pressure level. This means that the supply pressure at the motor inlet on the pump side is also constant. This again reduces the oscillating tendency of the system. Further, one ensures that no cavitation will occur even with a high external force.

In a preferred embodiment, the compensating valve is disposed between the motor and the second throttling point and is loaded in the opening direction by the pressure at the connection of the first throttling point on the motor side. With this construction, the compensating valve is placed in the open position during normal operation. However, if, as a result of an external force, the pressure on the supply side of the motor is too low, the pressure at the connection of the second throttling point on the container side is applied to the compensating valve by way of the refill check valve so that the compensating valve will then act by way of the second throttling point in the sense of holding the pressure drop constant It is also advisable for the main valve to be loaded in the opening direction by the pressure at the connection of the first throttling point on the pump side and in the closing direction by a spring and by the pressure at the second throttling point on the container side. During normal operation, the main valve is loaded in the closing direction by a comparatively weak pressure. It is therefore fully open. The throttling losses are correspondingly low. However, during braking operation, when the refill check valve is open, the pressure at the connection of the second throttling point on the container side is equal to that at the connection of the first throttling point on the motor side. Consequently, the main valve is operated depending on the pressure drop at the first throttling point. During braking operation, therefore, the main valve assumes the throttling position.

It is in this case advisable for the pressure chambers with the control faces for the pressure at the connection of the first throttling point on the pump side and for the pressure at the connection of the second throttling point on the container side to be disposed at the two end sections of the main valve slide. This results in a particularly simple construction because the pressure chambers can be located near the first and second throttling points and therefore short conduit distances are possible.

In a further form of the invention, an overpressure valve is connected between the motor connection on the delivery side and a pressure chamber of the main valve that has an overpressure control face acting in the opening direction of the second throttling point. If the overpressure valve responds, the second throttling point is necessarily opened. A small overpressure valve is therefore sufficient rapidly to reduce a large overpressure by way of the second throttling point.

It is in this connection advisable for the main valve to have a divided slide and for the pressure chamber with the overpressure control face to be disposed at the division.

Another possibility is for the pressure chamber having the overpressure control face to be connected to the connection of the first throttling point on the pump side by way of a throttle. By reason of the twofold use of this pressure chamber, a one-piece slide can be employed for the main valve.

Another possibility is for both motor conduits to be each provided with a combination of main valve and compensating valve. In this way, external forces in both operating directions of the motor can be considered.

Preferably, the spring of the compensating valve and/or of the main valve is adjustable. In this way, the quantity of the refilling medium can be kept to a minimum. Different inlet and outlet volume ratios of the motor can also be considered, such as are present with stepped pistons.

Desirably, the second throttling point is provided with a seating valve. One therefore obtains a leakage-free closure of the motor outlet such as is impossible to achieve with a simple slide valve.

Further, the main valve and compensating valve may be accommodated in a valve block on the motor housing. There will therefore be no danger of a conduit for the pressure medium braking between the motor and the valve block.

BRIEF DESCRIPTION OF THE DRAWINGS

Preferred examples of the invention will now be described in more detail with reference to the drawing, wherein.

DETAILED DESCRIPTION OF THE PREFERRED EMBODIMENTS

Figure 1:
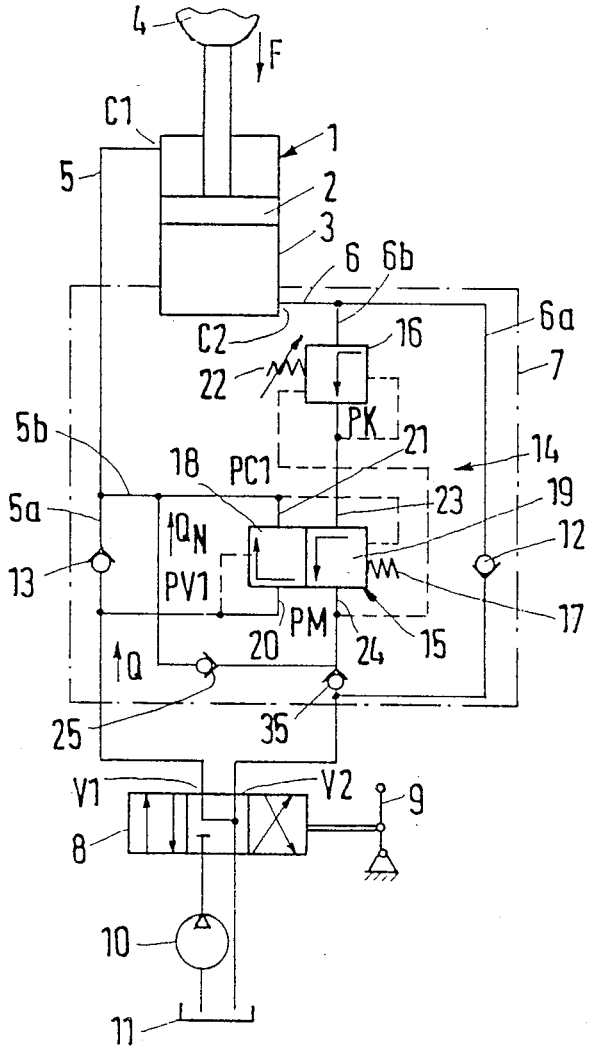
FIG. 1 shows one embodiment of a control circuit for a hydraulic motor with a safety brake valve arrangement according to the invention.

FIG. 1 illustrates a control circuit for a hydraulic motor 1 having a stepped piston 2 in a cylinder 3 and constantly loaded by an external load 4 represented by a force F. The two motor connections ports C1 and C2 are each connected to a motor conduit 5 or 6 which communicate with the two connections ports V1 and V2 of a control valve 8 by way of a valve block 7 fixed to the cylinder 3. This control valve can be moved with the aid of a handle 9 out of the illustrated neutral position into one of two operating positions in which the motor 1 is supplied with pressure fluid from a pump 10 depending on the direction and the discharged fluid is returned to a container reservoir 11. The control valve 8 is designed as a proportional valve which has not been illustrated in more detail.

The motor conduit 5 is divided into a delivery return portion 5*a* and a supply portion 5*b* and the motor conduit 6 into a supply portion 6*a* and a delivery return portion 6*b*. During lifting operation, the supplied pressure fluid is fed through a check valve 12 in the supply portion 6*a* and the delivered fluid through a check valve 13 in the delivery portion 5*a*. The overall regulation of the quantity is effected by the control valve 8.

During lowering operation, a safety brake valve arrangement 14 becomes effective This consists of a main valve 15 and a compensating valve 16 which is connected in the delivery portion 6*b* of the motor conduit 6 between the connection C2 of the motor 1 and the operating valve 15. In the rest position, the operating valve 15 is brought by a spring 17 into the illustrated blocking position in which the delivery portion 6*b* as well as the supply portion 5*b* are blocked. This ensures that, when the control valve 8 is not actuated, the pressure fluid contained in the motor 1 will not flow off and therefore the load cannot drop in an uncontrolled manner.

The main valve 15 forms a first throttling point 18 with a variable aperture in the supply portion 5*b* and a second throttle point 19 with variable aperture in the delivery portion 6*b*. The main valve 15 is loaded in the opening direction by the pressure PV1 at the connection 20 of the first throttling point 18 on the pump side and in the closing direction by the pressure PC1 at the connection 21 of this throttling point on the motor side. The main valve 15 therefore assumes a position in which the pressure drop at the first aperture corresponds to the force of the spring 17. The first aperture thus defined corresponds to a second aperture at the throttling point 19. This may have any desired functual relationship to the first aperture and is preferably proportional thereto.

The compensating valve 16 is forced into the open position by an adjustable spring 22. A pressure PK at the connection 23 of the second throttling point 19 on the motor side acts in the closing direction and a pressure PM at the connection 24 of the second throttling point 19 on the container side acts in the opening direction. Consequently, during lowering operation, the compensating valve 16 assumes such a position that the pressure drop at the second throttling point 19 is held constant. With a given second aperture, the outflowing quantity is therefore constant independently of the external force F and corresponds to the supply quantity Q.

Between the connection 24 of the second throttling point 19 on the container side and the connection 21 of the first throttling point 18 on the motor side there is a refill check valve 25 which opens in a direction towards the motor 1. If, therefore, the external force F creates a pressure in the motor conduit 5 that is too low, refilling takes place immediately by way of the refilling valve 25 so that there is no danger of cavitation. A check valve 35 in the delivery part 6*b* of the motor conduit 6 prevents a short circuit by way of the refill check valve 25 during lifting operation.

Figure 2:
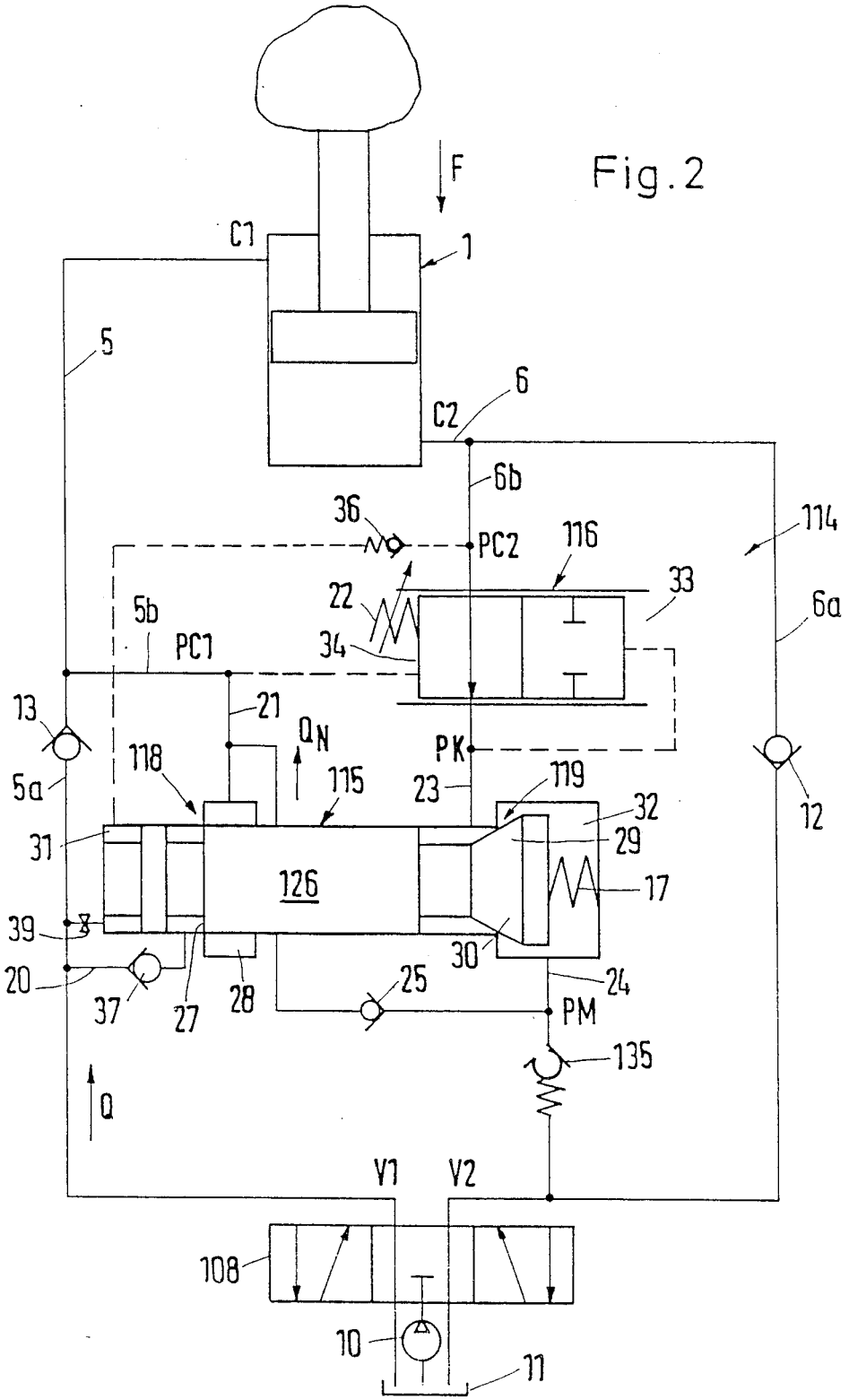
FIG. 2 shows a modified embodiment.

FIG. 2 shows a modified circuit in which the same parts are given the same reference numerals and corresponding parts have reference numerals increased by 100. The main valve 115 comprises a slide 26. A control edge 27 together with an annular groove 28 forms the first throttling point 118. A conical closure member 29 together with a seat 30 forms the second throttling point 119. The connection 20 of the first throttling point 118 on the pump side is connected by way of a throttle 39 to a pressure chamber 31 having a control face. The connection 24 of the second throttling point on the container side is connected to a pressure chamber 32 having a control face.

In the compensating valve 116, a pressure chamber 33 with an associated control face is, as in FIG. 1, supplied with pressure PK at the connection 23 of the second throttling point 119 on the motor side. On the other hand, the opposite pressure chamber 34 communicates with the pressure chamber PC1 at the connection 21 of the first throttling point 118 on the motor side.

In addition, a spring-loaded check valve as a counter-pressure valve 135 is provided in series with the second throttle point 119 between the latter and the control valve 108. This holds the pressure PM at a certain level independently of the quantity of flow. The pressure PM is designed to bring about effective refilling.

During normal operation, the operating valve 115 is held open by the pump pressure and the compensating valve 116 by the spring 22 and the pressure PC1. In both valves, throttling losses therefore do not occur. However, if, as a result of external forces F, the supply pressure PC1 of the motor 1 drops below the value PM, a refill quantitity $Q_N$ flows through the refill check valve 25 to the connection C1. The pressures PM and PC1 are therefore substantially equal. Consequently, the slide 126 is under the influence of the pressure drop at the first throttling point 118 and the compensating valve 116 is under the influence of the pressure drop at the second throttling point 119. This results in a braking operation during which the outflowing amount of liquid is held constant.

The force of spring 17 is an expression for the amount Q supplied by the control valve 108. The force of spring 22 is a measure of the amount of liquid flowing back from the motor 1. If the return liquid is more than the supply liquid, there is a need for replenishment leading to the refill flow $Q_N$. By reducing the force of spring 22 and/or by increasing the force of spring 17, the need for refilling is reduced. It is therefore readily possible to set a minimal refill quantitity which is nevertheless sufficient for stable operation. As soon as the refill check valve 25 opens, the upper piston chamber of the motor 1 is at a constant pressure PM. Any oscillations that occur are rapidly reduced.

An overpressure valve 36 is connected between the connection C2 of the motor 1 and the pressure chamber 31 of the valve 115. In addition, the connection 20 is provided with a check valve 37 which blocks in a direction towards the pump. If, in the neutral position of the control valve 108, i.e. with the throttling point 119 closed, an excessive external force F acts on the motor 1 and overpressure therefore occurs at its connection C2, the overpressure valve 36 will open so that, by reason of the throttle 39, the overpressure is effective in the pressure chamber 31. This opens the main valve 115 for a short time so that the overpressure can be rapidly reduced. A comparatively small overpressure valve 36 is sufficient for this purpose. The pressure face of the pressure chamber 30 therefore not only acts as a normal control pressure face but also as an overpressure control face.

Figure 3:
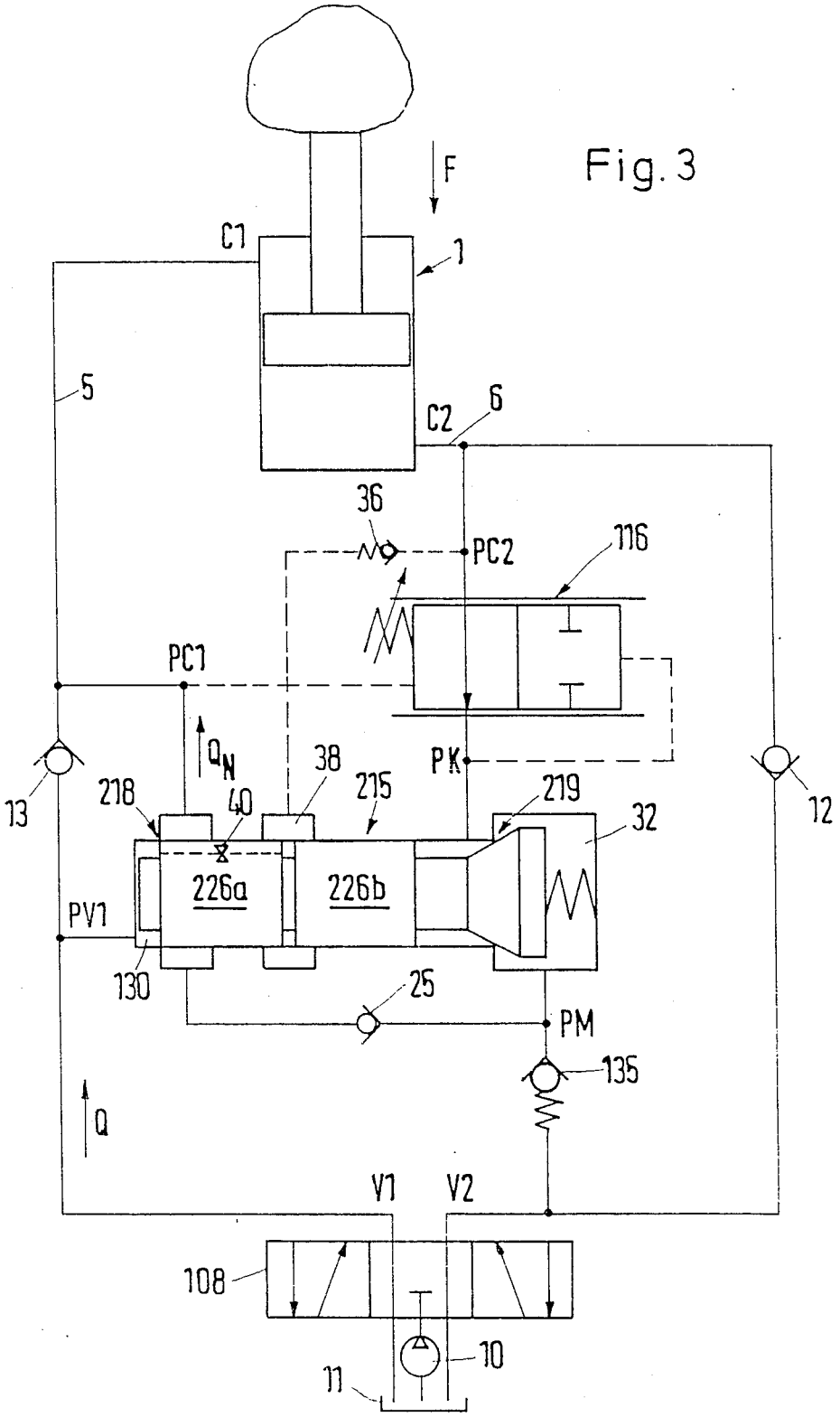
FIG. 3 shows a third embodiment.

FIG. 3 illustrates a very similar circuit in which the same parts have the same reference numerals and similar parts have reference numerals increased by 200. The main difference is that the main valve 215 comprises a slide consisting of two parts **226*a* and 226*b*. At the dividing gap there is a pressure chamber 38 which is connected to the connection C2 of the motor 1 by way of the overpressure valve 36. If an overpressure occurs here, the slide portion 226*b* is pushed to the right so that this overpressure can be rapidly relieved. A throttle passage 40 leading to the pressure chamber 130 permits the slide portion 126*b*** to return when the overpressure goes back.

Figure 4:
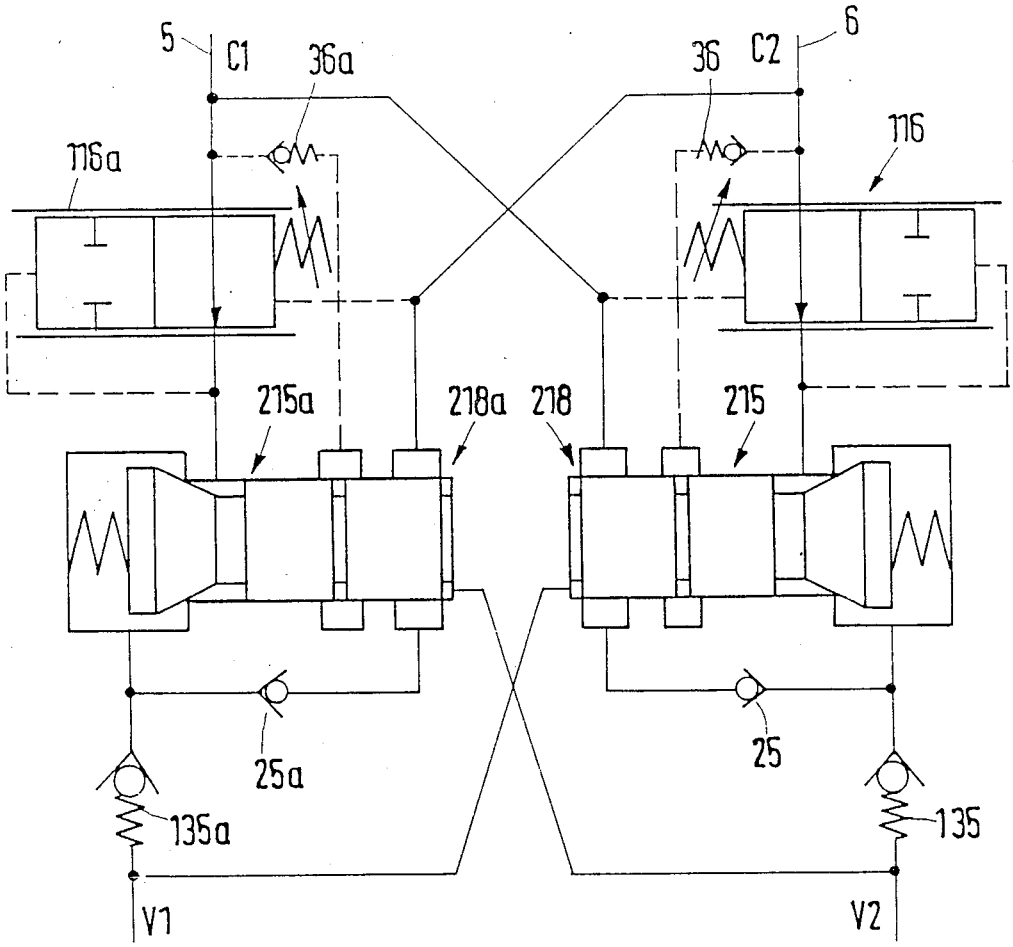
FIG. 4 shows a further embodiment.

In the FIG. 4 embodiment, there is a set of valves of the kind known from FIG. 3, namely the refill check valve 25, the counter-pressure valve 35, the overpressure valve 36, the compensating valve 116 and the main valve 215 and, in mirror image thereto, the same set of valves **25*a*, 35*a*, 36*a*, 116*a* and 215*a*. This utilises the fact that the slides of the main valves 215 and 215*a* prevent return flow through the first throttling point 218 or 218*a* because these are closed. Return flow from the connection C1 must therefore take place by way of the left-hand valve group and return flow from the connection C2** by way of the right-hand valve group. In both cases, the desired safety is obtained.

Altogether, one therefore achieves a valve arrangement with which the motor subjected to an external force F is secured against movement as a result of hose or tube fracture, wherein the cylinder outlet is sealed against leakage by a seating valve, shock pressure effects can be relieved by an overpressure valve and, above all, the lowering movement occurs uniformly and oscillations in the system are avoided.

I claim:

1. A hydraulic safety brake valve arrangement for a motor operable under pressurized fluid in a first direction in opposition to an external loading force and a second direction opposite the first direction, the motor having a first port for the application of fluid under pressure for operating the motor in the first direction and allowing discharge of fluid when the motor is operating in the second direction, and a second port for allowing the discharge of fluid when the motor is operated in the first direction and for the application of fluid under pressure for operating the motor in the second direction, a fluid reservoir, a pump fluidly connected to the reservoir, and a control valve having a first port fluidly connected to the pump, a second port fluidly connected to the reservoir, a third port, a fourth port, and a valve member operable between a rest position blocking fluid flow from the valve first port to either of the third and fourth ports, a second position for fluidly connecting the valve first port to the fourth port and the valve second port to the third port, and a third position for fluidly connecting the valve first port to the third port and the valve second port to the fourth port, comprising a first conduit for fluidly connecting the third port to the motor second port, a second conduit for fluidly connecting the fourth port to the motor first port, main valve means having first and second motor side connections that are respectively fluidly connected in the first conduit and the second conduit, and a pump side connection fluidly connected in the first conduit for forming a normally closed first throttle point between the pump connection and the motor first side connection that opens under the influence of pressure at the pump side connection to permit pressurized fluid flow through the first conduit to the motor second port, a reservoir side connection fluidly connected in the second conduit for forming a normally closed second throttle point between the motor side second connection and the reservoir side connection that when open permits return fluid flow from the motor first port, the first and second throttle points opening at the same time, and closing at the same time at least during braking operations, and compensating valve means in series with the second throttle point for holding the pressure drop constant at the second throttle point.

2. A hydraulic brake valve arrangement according to claim 1, characterized in that the main valve means has first and second main valves in the first and second conduit respectively, and that the compensating valve means has first and second compensating valves respectively in series with the respective one of the first and second main valves whereby the return flow from the motor first port has to flow through the first main valve and compensating valve and the return flow from the motor second port has to flow through the second main and compensating valves.

3. A hydraulic brake valve arrangement according to claim 1, characterized in that there is provided a valve block that is fixed to the motor and accomodates the main valve means and the compensating valve means.

4. A hydraulic brake valve arrangement according to claim 1, characterized in that the first conduit has a first branch and a first check valve in the first branch that is oriented to block fluid flow in a direction from the third port to the motor second port and through the first branch and to perfmit fluid flow from the motor second port to the third port and a second branch in parallel with the first branch that has the first throttle point therein, and that the second conduit has a third branch and a second check valve in the third branch that is oriented to block block fluid flow in a direction from the motor first port to the fourth port and permit fluid flow in a direction from the fourth port to the motor first port and a fourth branch in parallel with the third branch and having the compensating valve means and the second throttle point herein.

5. A hydraulic valve arrangement according to claim 4, characterized in that a refill check valve is fluidly connected to the third branch between the reservoir side connection and the fourth port and to the second branch between the first connection and the motor second port, the refill check valve being oriented to permit fluid flow from the third branch to the second branch when the pressure at the reservoir side connection is greater than the motor side first connection and block fluid flow from the second branch to the third branch.

6. A hydraulic safety brake valve arrangement according to claim 1, characterized in that the main valve means includes a pressure chamber having an overpressure control face acting in the opening direction of the second throttle point and a valve slide, and that there is provided an overpressure valve that is fluidly connected to the second conduit between the compensating valve and the second motor port, and to the pressure chamber.

7. A hydraulic safety brake valve arrangement according to 6, characterized in that the slide has a first part, a second part and a division gap between the parts and that the pressure chamber opens to the division gap.

8. A hydraulic safety brake valve arrangement according to claim 6, characterized in that there is provided a throttle connected between the pressure chamber and the first conduit.

9. A hydraulic safety brake valve arrangement according to claim 1, characterized in that the compensating valve means includes a compensating valve, means for loading the compensating valve in a closing direction by the pressure at the motor side second connection and means for resiliently biasing the compensating valve in an opening direction in combination with the pressure at the reservoir side connection.

10. A hydraulic safety valve arrangement according to claim 9, characterized in that the compensating valve is disposed between the motor first port and the motor second side connection, and has a fluid connection to the reservoir side connection to be loaded in an opening direction by the pressure at the reservoir side connection.

11. A hydraulic safety valve arrangement according to claim 1, characterized in that there is provided a counter-pressure valve in the second conduit between the reservoir side connection, and that the fourth port that holds the pressure at the reservoir side connection substantially constant at a value higher than the reservoir pressure.

12. A hydraulic safety valve arrangement according to claim 1, characterized in that there is provided a refill check valve fluidly connected to the reservoir side connection and to the motor first side connection for blocking fluid flow from the first conduit to the second conduit while being oriented to open in the direction toward the motor side connection.

13. A hydraulic safety valve arrangement according to claim 12, characterized in that the main valve means has a valve member, a fluid connection to the pump side connection for biasing the valve member in an opening direction, and a combination of a spring and a fluid connection to the motor side first connection for biasing the valve member in a closing direction to provide the normally closed throttle points.

14. A hydraulic safety valve arrangement according to claim 13, characterized in that the main valve means includes an annular groove, a valve seat and opposite first and second pressure chambers, the valve member having opposite first and second end sections disposed in the first and second pressure chambers respectively, the first end section and the annular groove forming the first throttle point, the second end section having a conical portion, the valve seat and conical portion forming the second throttle point.

15. A hydraulic safety valve arrangement according to claim 1, characterized in that the first conduit has a first branch, a second branch and a first check valve in the first branch that is oriented to block fluid flow through the first branch in a direction from the third port to the motor second port and to permit fluid flow from the motor second port to the third port, the second branch being in parallel with the first branch and having the first throttle point therein for fluidly connection to the first branch between the first check valve and the third port and to the pump side connection for applying pressure to the main valve means to urge the main valve means to block fluid blow therethrough between the motor first side connection and the pump side connection, and to the first motor side connection and the first branch between the first check valve and the motor second port, and that the second conduit has a third branch and a second check valve in the third branch that is oriented to block fluid flow in a direction from the motor first port to the fourth port and through the third branch and to permit fluid flow from the fourth port to the motor first port and a fourth branch that is parallel with the third branch that has the second throttle point therein for fluid connection to the third branch between the check valve and the fourth port and to the third branch between the motor first port and the second check valve.

16. A hydraulic brake arrangement according to claim 15, characterized in that the compensating valve means includes means for resiliently retaining it in an open condition and being operable under fluid pressure to a closed condition and that the fourth branch includes a first branch part and a second branch part that has the compensating valve means therein for connection to the third branch between the motor first port and the second check valve and to the second motor side connection and to the first branch part for applying fluid pressure to urge the compensating valve means to an open condition and to the compensating valve means for applying the fluid pressure at the second motor side port to urge the compensating valve means to its closed position, the first branch part being fluidly connected to the reservoir side connection and to the third branch between the second check valve and the fourth port.

* * * * *